United States Patent [19]

Hiyoshi et al.

[11] 4,080,862

[45] Mar. 28, 1978

[54] ELECTRONIC MUSICAL INSTRUMENT HAVING OCTAVE SLIDE EFFECT

[75] Inventors: Teruo Hiyoshi; Akira Nakada; Shigeru Yamada, all of Hamamatsu; Kiyoshi Ichikawa, Hamakita; Shigeki Ishii, Hamamatsu, all of Japan

[73] Assignee: Nippon Gakki Seizo Kabushiki Kaisha, Hamamatsu, Japan

[21] Appl. No.: 716,513

[22] Filed: Aug. 23, 1976

[30] Foreign Application Priority Data

Aug. 29, 1975 Japan ..... 50-104573

[51] Int. Cl.[2] ..... G10H 1/02

[52] U.S. Cl. ..... 84/1.24; 84/1.03; 84/1.17; 84/1.01

[58] Field of Search ..... 84/1.03, 1.17, 1.19, 84/1.24, 1.01, 1.1, 1.11

[56] References Cited

U.S. PATENT DOCUMENTS

| | | | |
|---|---|---|---|
| 3,718,748 | 2/1973 | Bunger | 84/1.03 X |
| 3,725,562 | 4/1973 | Munch, Jr. et al. | 84/1.03 X |
| 3,854,366 | 12/1974 | Deutsch | 84/1.03 X |
| 3,910,150 | 10/1975 | Deutsch et al. | 84/1.24 X |
| 3,929,053 | 12/1975 | Deutsch | 84/1.24 |

*Primary Examiner*—Ulysses Weldon
*Attorney, Agent, or Firm*—Spensley, Horn & Lubitz

[57] ABSTRACT

An electronic musical instrument wherein, by merely depressing one key, the tone pitch corresponding to that key varies periodically with cyclic repetition at a specific rate. The pitch variation is made on the octave basis by periodically shifting digits of binary signals of plural bits which designate readout addresses of a musical tone waveform. Various patterns of the pitch variation can be obtained by suitably setting a pattern of shifting of the digits of the binary signals. The patterns include an "up mode" in which the pitch slides successively toward higher pitches one octave interval at a time and then, upon reaching a predetermined octave, immediately returns to the original pitch and subsequently the same operation is repeated, and a "turn mode" in which the pitch slides successively toward higher pitches one octave interval at a time and, upon reaching a predetermined octave, slides successively in the reverse direction until it returns to the original pitch and subsequently the same operation is repeated. The patterns further include a "jump mode" in which, when a plurality of keys are successively depressed, the pitches of the succeedingly depressed keys slide in conformity with the octave slide of the first depressed key and a "random mode" in which, when a plurality of keys are successively depressed, the octave slide of the respective keys is made independently and separately from each other. In a case where plural keys are depressed, the "up mode" or the "turn mode" can be selectively combined with the "jump mode" or the "random mode". The speed of the octave slide is determined by the rate of the clock pulse employed in the instrument and, accordingly, a clock pulse of a rate corresponding to a note to be played is selectively used.

6 Claims, 11 Drawing Figures

JUMP MODE

RANDOM MODE

ELECTRONIC MUSICAL INSTRUMENT HAVING OCTAVE SLIDE EFFECT

BACKGROUND OF THE INVENTION

This invention relates to an electronic musical instrument wherein, by merely depressing one key, a renditional effect such that the pitch corresponding to that key varies periodically with cyclic repetition at a specific rate is realized.

An electronic musical instrument in which this invention is applied is an apparatus of a system wherein successive sample point amplitude values of muscial tone waveform are stored in a memory, and addresses for reading out the musical tone waveform sample point amplitude values from this memory are designated by binary signals of a plurality of bits. Electronic muscial instruments of systems of this character have already been disclosed in the specification of U.S. Pat. No. 3,882,751.

The binary signals of a plurality of bits for reading out the waveforms from the memory are obtained by successive accumulation of a constant proportional to the frequency of the musical tone at each constant sample period. With this accumulation, the value of the binary signal increases, and the phase of the musical tone waveform read out is advanced. Accordingly, the quantity of increase of the binary signal at each sample period is constant, and the advance of the phase in a constant period (sample period) becomes constant, whereby a musical tone waveform of constant frequency is obtained.

In the case where the tonal pitch of a musical tone emitted in an electronic musical instrument of this character is to be varied rhythmically and periodically, a relatively high degree of playing technique wherein a plurality of keys must be successively depressed in a rhythmical manner has heretofore been required of the musical playing the instrument. The reason for this is that, since only a certain frequency (tonal pitch) can be obtained by merely depressing one key in a conventional instrument, appropriate keys as necessary must be selected.

SUMMARY OF THE INVENTION

It is an object of the present invention to provide an electronic musical instrument in which a renditional effect wherein, by merely depressing one key, the tonal pitch of the musical tone thus emitted is periodically and repeatedly varied can be automatically realized.

Another object of the invention is to provide an electronic musical instrument in which, when a plurality of keys are being simultaneously depressed, an octave-slide effect is realized with respect to each of the keys.

These and other objects as well as further features of this invention will be apparent from the following detailed description when read in conjunction with the accompanying drawings.

DETAILED DESCRIPTION OF THE INVENTION

The octave-slide effect is an effect wherein the pitch of the musical tone is caused to slide or skip at a specific rate at intervals of an octave, and the pattern of this "sliding" is periodically repreated. By this effect, even a beginner becomes able to render a musical performance of high level by merely depressing a single key.

In order to attain this sliding in accordance with the present invention, the digits of the binary signals of the aforementioned plurality of bits which designate the readout addresses of the musical tone waveform memory are periodically shifted. As a result of a binary signal being shifted by one digit to a higher significant digit (left) or a lower significant digit (right), its value becomes twice or one half ($\frac{1}{2}$). Consequently, the phase of the musical tone waveform sample point amplitude read out from the musical tone waveform memory becomes twice or one half, and the frequency of the musical tone thus obtained becomes twice or one half. Thus, a tone of a pitch which is different from the original pitch by one octave is obtained.

For example, when the aforementioned binary signal corresponding to the original tonal pitch is first shifted by one digit and next shifted by two digits, a tone of a pitch which is different from the original pitch by one octave is first obtained, and next a tone of a pitch which is different from the original pitch by two octaves is obtained. In this manner, the tonal pitch is caused to successively slide one octave at a time. By varying periodically the value for designating the quantity of shift of the binary signal, the pitch of the musical tone can be periodically causes to slide.

For the purpose of periodically varying the shift quantity designating value, a counter circuit driven by an appropriate clock pulse and a conversion circuit for converting the output of the counter circuit into a shift quantity designating value are provided. Since the shift quantity designating value varies with the supply of the clock pulse, the rate of sliding of the pitch is determined by the rate of the above mentioned appropriate clock pulse. The pattern of periodic variation of the "sliding" is established in the above mentioned conversion circuit. For this variation pattern, various patterns can be set. In the musical instrument of this invention, the conversion circuit can be operated by selecting a desired pattern.

For example, it is possible to set a pattern wherein the pitch slides successively toward higher values one octave interval at a time, that is, from the original pitch (0) successively through 1 octave (+1), 2 octaves (+2), octaves (+3), etc., and then, after it reaches a predetermined octave, immediately returns to the original pitch, and thereafter successive "sliding" through 1 octave, 2 octaves, etc., is repeated. This will hereinafter be referred to as an "up mode".

Figure 1:
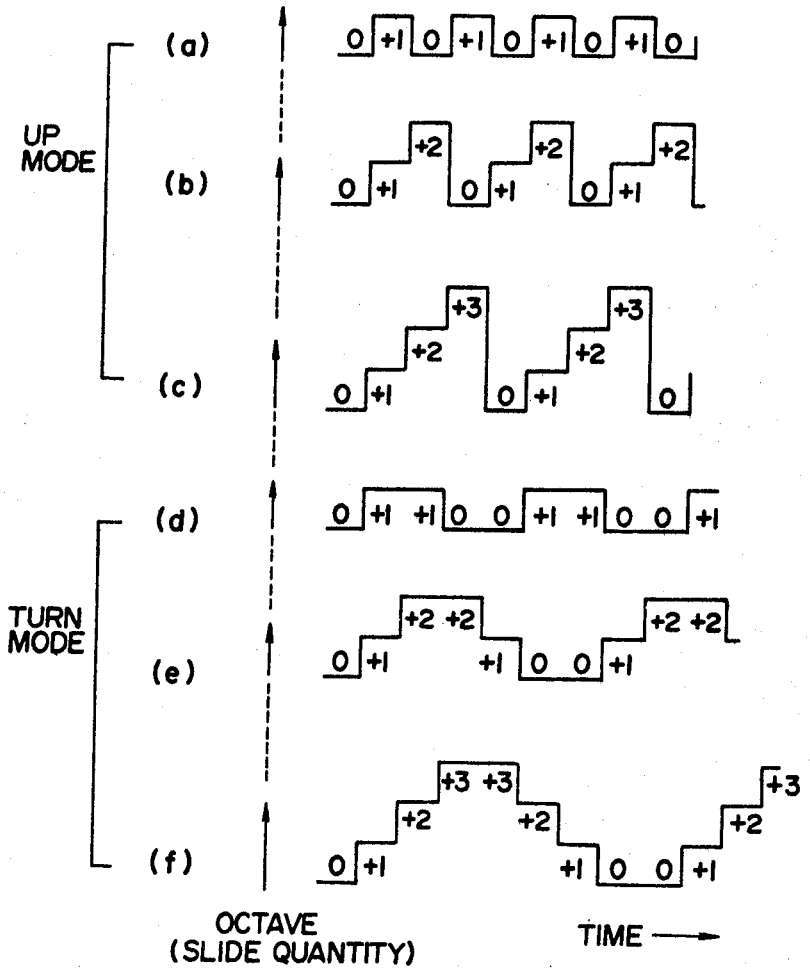
FIG. 1 comprises graphs indicating one example of tone pitch variation patterns according to this invention.

Furthermore, as indicated in FIGS. 1(*d*), 1(*e*), and 1(*f*), it is possible to set a pattern wherein the pitch slides toward higher values successively by one octave interval at a time, that is, from the original pitch (0) through 1 octave (+1), 2 octaves (+2), 3 octaves (+3), etc., and, upon reaching a predetermined octave, slides successively in the reverse direction, that is, from the high octave thus reached through 3 octaves, 2 octaves, and 1 octave and then to the original pitch, this sliding thereafter being repeated. This will hereinafter be referred to as a "turn mode".

The above mentioned predetermined octave, that is, the final slide quantity (equal to the shift quantity of the binary signal) can be set at will in either the above mentioned up mode or the turn mode. In FIGS. 1(*a*), 1(*b*), and 1(*c*) or in FIGS. 1(*d*), 1(*e*), and 1(*f*), three cases wherein the final octaves are 1 octave, 2 octaves, and 3 octaves are respectively indicated. The term "slide" is herein used to designate shifting of the pitch at an interval of one octave.

Next, in the case where a plurality of keys are simultaneously depressed, the octave slide effect is obtained by individually shifting the binary signals of the aforementioned plurality of bits in the channels in which the tone production of the respective keys has been assigned. In the case where successive depressing of the keys has been started, it is possible to obtain a sliding of the pitch wherein, in conformity with the octave slide variation of the first depressed key (first key), the pitches of the succeedingly depressed keys (second key, third key, etc) are caused to slide. This will hereinafter be referred to as a "jump mode".

Figure 2:
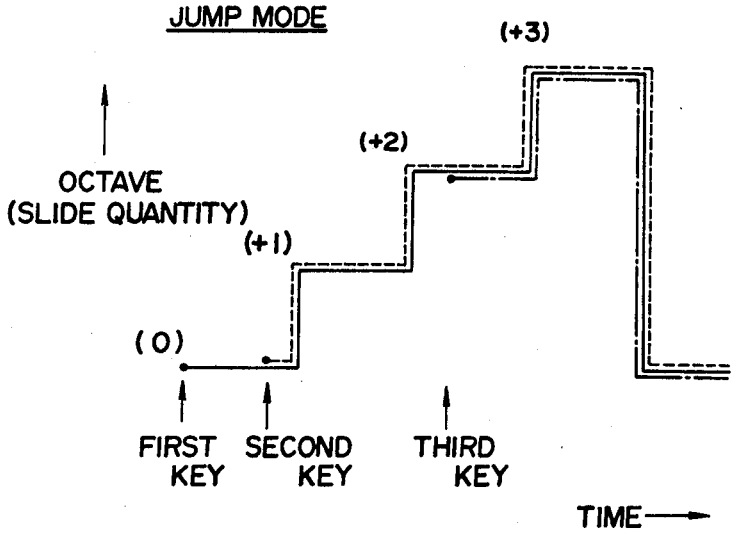
FIG. 2 comprises graphs indicating one example of tone pitch variation patterns according to this invention with respect to multiple tones.
Figure 2:
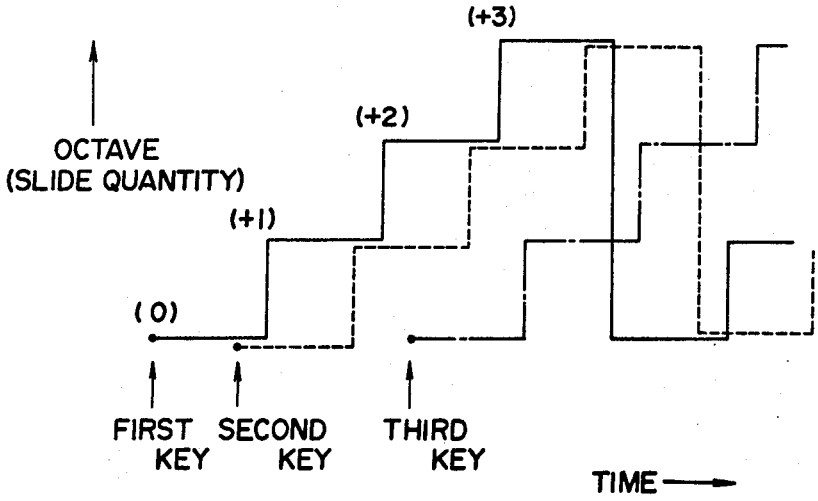

One example of this jump mode is illustrated in FIG. 2(*a*). In this figure, the first key is in the up mode, and its pitch is caused to slide from the original pitch (0) successively to the 3-octave higher pitch (+3). If when the pitch is at its original value (0), the second key is depressed, its tone will start to be produced from the original pitch (0) but shortly thereafter will follow up the slide of the first key is indicated by broken line. If, when the slide quantity becomes 2 octaves (+2), the third key is depressed, tone reproduction will start from a pitch offset by 2 octaves from the original pitch as a follow-up to the "pitch slide" of the first key as indicated by single-dot chain line. Consequently, a plurality of tones will vary with the same timing.

Furthermore, it is possible to cause the pitches of the various tones to slide separately and independently. This will hereinafter be referred to as a "random mode". One example of a random mode is shown in FIG. 2(*b*). In the random mode, even if successive depressing of the keys is commensed, individually unique octave slide effects are respectively imparted as indicated in FIG. 2(*b*) to the tones of the first key (solid line), the second key (broken line), the third key (single-dot chain line), etc.

Figure 3:
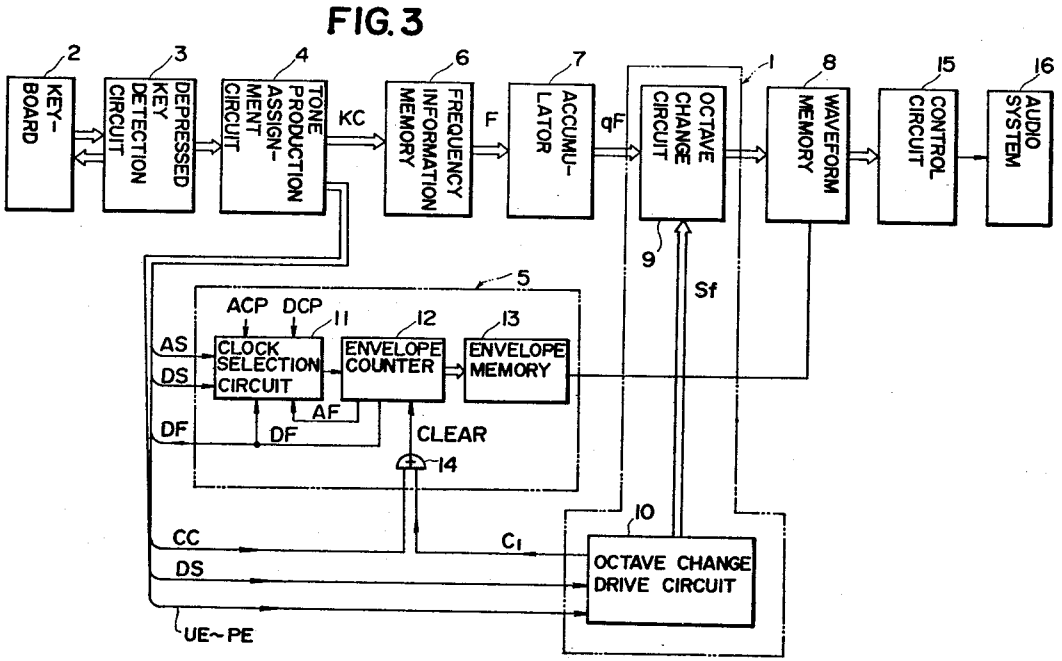
FIG. 3 is a block diagram showing the essential construction of one example of the electronic musical instrument of the invention.

The general construction of the electronic musical instrument according to the present invention is illustrated by block diagram in FIG. 3. While the principal feature of the invention resides in the provision and the construction of the octave slide control device 1, a description of the construction of the entire musical instrument will first be set forth as conductive to a full understanding of the invention.

This musical instrument has a depressed key detection circuit 3 operating to detect the on-off operations of the key switches of all of the keys mounted on a keyboard 2 and to produce, as output, information for discriminating keys which have been depressed. This information produced as output from the depressed key detection circuit 3 is received by a tone production assignment circuit 4, which thereupon operates to assign the tone production of the key represented by this information to one of the channels corresponding to the maximum simultaneous tone production number (for example, 12 tones).

This assignment circuit 4 has memory (storing) positions corresponding to all channels and operates to store a key code KC representing a certain key at the memory position corresponding to the channel to which the tone production of that key has been assigned and to produce successively as output in a time-division manner the key codes KC stored in the respective channels. Accordingly, when a plurality of keys are being simultaneously depressed at the keyboard 2, these depressed keys are assigned to respectively separate channels for tone production, and key codes KC representing the assigned keys are respectively stored in the memory positions corresponding to these channels.

The memory positions can be formed by a shift register of circulating type. For example, each of the key codes KC for specifying the keys on the keyboard 2 can be constituted by codes of a total of 9 bits, namely, a code of 2 bits $K_2$ and $K_1$ representing keyboard kind, a code of 3 bits $B_3$, $B_2$ and $B_1$ representing octave ranges or pitch compass, and a codes of 4 bits $N_4$, $N_3$, $N_2$ and $N_1$ representing the notes within one octave as indicated in Table 1. Then, when the total number of channels is 12 in this case, a shift register of 12 stages (wherein one stage has 9 bits) can be used.

Table 1

| | | key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| keyboards | upper | 0 | 1 | | | | | | | |
| | lower | 1 | 0 | | | | | | | |
| | pedal | 1 | 1 | | | | | | | |
| octave ranges | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| notes | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

In the instant embodiment of the invention, the various counters, logical circuits, memory devices, and other components are constituted in a dynamic logic system so as to be commonly used in a time division manner. For this reason, the time relationships of the clock pulses for operational control are extremely important. The main clock pulse $\phi_1$, as indicated in FIG. 4(*a*), is used for controlling the time divisional operations of all channels and has a pulse spacing of 1 $\mu$s, for example, since the number of channels is 12, time slots of 1 $\mu$s width successively partitioned by the main clock pulse $\phi_1$ are defined successively as the first through twelfth channels.

Figure 4:
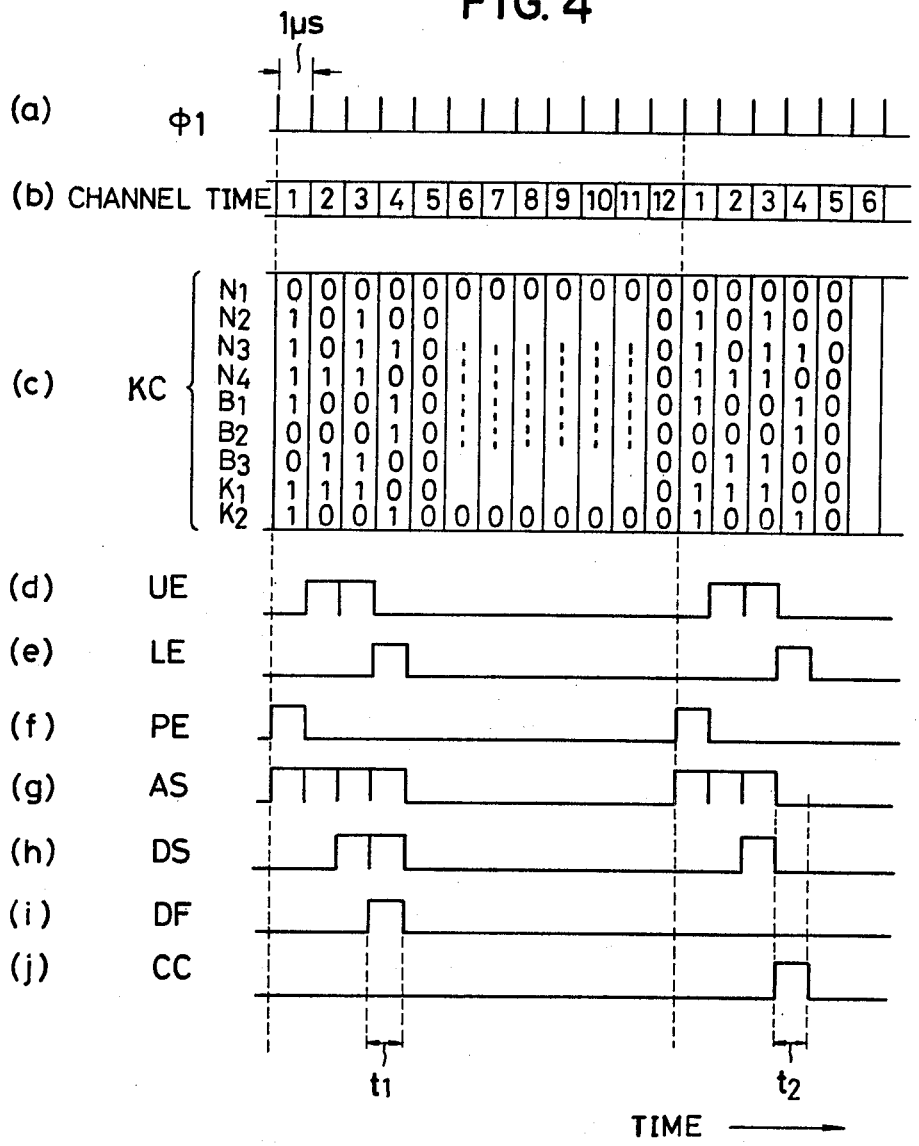
FIG. 4 is a timing chart indicating the operation of a circuit for tone production assignement in the instrument shown in FIG. 3.

As indicated in FIG. 4(*b*) the time slots are respectively named as first channel time through twelfth channel time. The twelve channel times are provided by circulation. Consequently, the key codes KC (i.e., the key codes stored in the aforementioned shift register) representing the keys assigned for tone production by the tone production assignment circuit 4 are successively delivered as outputs in a time divisional manner in coincidence with the times of the assigned channels.

For example, it will be assumed that the C tone of the second octave range of the pedal keyboard is assigned to the first channel, that the G tone of the fifth octave range of the upper keyboard is assigned to the second channel, that the C tone of the fifth octave range of the upper keyboard is assigned to the third channel, that the E tone of the fourth octave range of the lower keyboard is assigned to the fourth channel, and that tone reproduction is not assigned to the fifth through twelfth channels. Then, the contents of the key codes KC time-divisionally produced as output from the assignment circuit 4 in synchronism with the channel time become as indicated in FIG. 4(*c*). The outputs of the fifth through twelfth channels are all "0".

Furthermore, the tone production assignment circuit produces time divisionally as outputs, in synchronism with the channel times, an attack start signal (or key-on signal) AS indicating that tone reproduction is to be carried out in the channel which has been assigned for tone production for a depressed key. In addition, this tone production assignment circuit produces time divisionally as output, in synchronism with the channel times, a decay start signal (or key-off signal) DS indicating that the keys for which tone production has been assigned to the respective channels have been released, whereby the tone production is to assume a decaying state. These signals AS and DS are utilized for amplitude envelope control (tone production control) of musical tones.

The tone production assignment circuit 4, moreover, receives a decay finish signal DF from an envelope generating circuit 5 described hereinafter indicating completion of tone production in a channel thereof and operates in response to this signal DF to clear the memories relating to the relevant channel and to produce as output a clearance signal CC for fully clearing the tone production assignment. Furthermore, the tone production assignment circuit 4 synchronizes with the production of the key code KC thereby to produce as output keyboard signals UE, LE, and PE for indicating the keyboard to whose key this key coade KC relates.

The identity of the keyboard concerned can be determined from the contents of the bits $K_2$ and $K_1$ indicating keyboards. For example, in the case of FIG. 4(*c*), as indicated in FIGS. 4(*d*), 4(*e*), and 4(*f*), a pedal keyboard signal PE is generated in the first channel time, an upper keyboard signal UE in the second channel time and the third channel time, and a lower keyboard signal LE in the fourth channel time. It will be assumed, in the case of FIG. 4(*c*), that the keys assigned to the first and second channels are at present being depressed, that the keys assigned to the third and fourth channels are released and the tone production thereof is in a decay or attenuation state, that, in the fourth channel, tone production is completed and a decay completion signal DF is generated at the time of the time slot $t_1$, and a clear signal CC is produced as output at the time of the time slot $t_2$, which is delayed by the 12 channel time. Then, under these conditions, the signals AS, DS, DF, and CC will be generated as indicated in FIGS. 4(*g*) through 4(*j*).

Since the clearance signal CC is produced as output at the time of the time slot $t_2$, the attack start signal AS and the decay start signal DS of the fourth channel are cleared. At this time, the key code KC of the fourth channel time of FIG. 4(*c*) and the lower keyboard signal LE of FIG. 4(*e*) are also erased but, in the illustration, are shown as they are for convenience in description.

The identity of the channels relating to the various signals KC, AS, DS, CC, UE, and PE produced as output from the tone production assignment circuit 4 can be distinguished by the channel times as indicated in FIG. 4.

Detailed illustrations of examples of circuits for the above described tone production assignment circuit 4 and the depressed key detection circuit 3 will not be shown in the drawings. For these circuits 3 and 4, any of the devices already disclosed, for example, in the specification of U.S. Pat. No. 3,882,751 can be used. The depressed key detection circuit 3 and the tone production assignement circuit 4 can, of course, comprise devices other than the devices disclosed in the specifications of the above cited U.S. patent, but such devices will not herein be described in detail.

Since a key code KC sent out from the note production assignment circuit 4 indicates a depressed key, this key code KC is used as an address designation signal for causing numerical information corresponding to the musical tone frequency of the key.

The frequency information memory 6 comprises, for example, a read-only memory in which frequency information F(constant) corresponding to the key code KC of each key has been stored beforehand. When a certain key code KC is applied to this memory 6, the frequency information F stored at the address designated by this key code KC is read out. This frequency information F is periodically and successively accumulated in an accumulator 7 for reading out the amplitude of musical tone waveform at constant time intervals in a waveform memory 8. Accordingly, the frequency information F is a digital numerical value proportional to the musical tone frequency of the assigned key, e.g. a binary numeral signal of 15 bits such as, for example, that disclosed in the specification of U.S. Pat. No. 3,882,751. When this frequency information F is represented in a decimal notation, it is a numerical value including values below the decimal point (decimal fraction), and the most significant bit of the 15 bits corresponds to an integer portion, while the remaining 14 less significant bits represent values below the radix point.

The value of the frequency information F is immediately determined upon specification of the value of a musical tone frequency on the basis of a specific sampling rate. For example, if it is assumed that, when the value $q$F(where $q=1, 2, 3, \ldots$) resulting from a successive accumulation of frequency information F in the accumulator 7 becomes 64 in decimal notation, the sampling of one musical tone waveform is completed, and, moreover, this accumulation is carried out every 12 $\mu$s during which the total channel time undergoes one circulation, the value of the frequency information F is determined by the equation $$F = 12 \times 64 \times f \times 10^{-6}$$

where $f$ is the frequency of the musical tone. This value of F is stored in the memory 8 in correspondence to the frequency $f$ to be obtained. For example, since the musical tone frequency corresponding to the $C_2$ note is 65.408 Hz, the value of F becomes 0.052325. The values of F for the other tones are determined in the same manner.

The relationships between the frequency f and the value of the frequency information F with respect to a number of notes taken as examples are indicated in Table 2.

Table 2

| | | frequency information F | | | | | | | | | | | | | | | |
|---|---|---|---|---|---|---|---|---|---|---|---|---|---|---|---|---|---|
| | | binary number | | | | | | | | | | | | | | | |
| | frequency (Hz) | integer part 15 | 14 | 13 | 12 | 11 | 10 | 9 | fraction part (bit) 8 | 7 | 6 | 5 | 4 | 3 | 2 | 1 | decimal numerical value |
| $C_2$ | 65.406 | 0 | 0 | 0 | 0 | 0 | 1 | 1 | 0 | 1 | 0 | 1 | 1 | 0 | 0 | 1 | 0.052325 |
| $C_3$ | 130.813 | 0 | 0 | 0 | 0 | 1 | 1 | 0 | 1 | 0 | 1 | 1 | 0 | 0 | 1 | 0 | 0.104650 |
| $C_4$ | 261.626 | 0 | 0 | 0 | 1 | 1 | 0 | 1 | 0 | 1 | 1 | 0 | 0 | 1 | 0 | 1 | 0.209300 |
| $C_5$ | 523.251 | 0 | 0 | 1 | 1 | 0 | 1 | 0 | 1 | 1 | 0 | 0 | 1 | 0 | 1 | 0 | 0.418600 |
| $C_6$ | 1046.502 | 0 | 1 | 1 | 0 | 1 | 0 | 1 | 1 | 0 | 0 | 1 | 0 | 1 | 0 | 0 | 0.837200 |
| $D_6$# | 1244.508 | 0 | 1 | 1 | 1 | 1 | 1 | 1 | 1 | 0 | 1 | 1 | 1 | 0 | 0 | 0 | 0.995600 |
| $E_6$ | 1318.510 | 1 | 0 | 0 | 0 | 0 | 1 | 1 | 1 | 0 | 0 | 0 | 0 | 0 | 0 | 1 | 1.054808 |
| $C_7$ | 2093.005 | 1 | 1 | 0 | 1 | 0 | 1 | 1 | 0 | 0 | 1 | 0 | 1 | 0 | 0 | 1 | 1.674400 |

The accumulator 7 operates to accumulate (cumulatively add the frequency information F of respective channels at a specific sampling rate (a rate of 12 μs per channel) and, obtaining an accumulated value qF, to advance the phase of the musical tone waveform to be read out every sampling time (12 μs). When the accumulated value qF reaches the decimal system number 64, it overflows and returns to zero, whereupon the reading out of one waveform is completed. Since the decimal number 64 can be represented by a binary signal of 6 bits, a counter wherein the capacity of one stage is 20 bits (the less significant digits of 14 bits being the binary fractional part, and more significant digits of 6 bits being the binary integer part) is used in order to accumulate the frequency information F in which the fifteenth bit corresponds to the first integer position and to sustain the counting effect until the accumulation value qF becomes 64. The accumulator 7 preferably comprises an adder of 20 bits and a shift register of 12 stages - 20 bits for convenience is being used in a time-division manner for the respective channels.

A musical tone waveform is divided into a plurality (e.g., 64) of sample points and a musical tone waveform memory 8 stores the amplitude values of these sample points successively in respective addresses. The value qF produced as output of the accumulator 7 becomes an input for designating the address to be read out from the memory 8. Since the number of addresses of the memory 8 is 64, the data of the more significant 6 bits corresponding to the integer value of the value $q$F are caused to be applied as address input to the memory 8. The date of the less significant 14 bits corresponding to the binary fraction value of the value qF are utilized only inside the accumulator 7 for accumulation.

As the accumulated value $q$F increases in the accumulator 7, the addresses for designating the amplitudes of the sample points to be read out are successively advanced, and the amplitude values of the respective sample points of the musical tone waveforms are successively read out from the memory 8.

The aforementioned octave slide control device 1 is inserted between the accumulator 7 and the musical tone waveform memory 8 and comprises an octave change circuit 9 and an octave change drive circuit 10. The octave change circuit 9 is adapted to appropriately shift, in accordance with a shift quantity designating signal Sf, the digits of the binary signal $q$F produced as output from the accumulator 7 in order to access the memory 8. Accordingly, the output qF (i.e., data of the more significant 6 bits representing the integer) of the accumulator 7 is introduced directly as it is into the memory 8 as input in the case where shifting is not designated and, in the case where shifting is designated, is changed into values which are 2 times, 4 times, 8 times, . . . in accordance with the shift quantity.

As a result of the changing of the value qF into values which are 2 times, 4 times, etc., in the octave change circuit 9, sample point amplitude values of addresses advanced by 2 times, 4 times, 8 times, etc., relative to addresses actually designated by the output $q$F of the accumulator 7 are read out from the memory 8. The increasing of the address by 2 times or 4 times or 8 times . . . in a specific sample period (12 μs in the instant example) means that the manner in which the phase of the musical tone waveform read out becomes 2 times or 4 times or 8 times . . . . This means that the musical tone frequency obtained becomes 2 times or 4 times or 8 times . . . , and the interval of the musical tone is changed by 1 octave or 2 octaves or 3 octaves . . . .

The octave change drive circuit 10 within the octave slide control device 1 is a circuit for generating the shift quantity designating signal of S$f$ and is adapted to periodically change the shift quantity thereby to realize various octave slide effects.

The aforementioned envelope generating circuit 5 is a known circuit, being disclosed in references such as the specification of U.S. Pat. No. 3,882,751, and operates to generate envelope waveforms for controlling the amplitude envelopes of musical tones. When an attack starting signal AS is applied from the assignment circuit 4, an attack clock pulse ACP is selected by a clock selection circuit 11 thereby to drive an envelope counter 12, and the envelope of an attack part stored in an envelope memory 13 is read out. Upon completion of the reading out of the attack part, an attack finish signal AF is produced as output from the counter 12, and the transmission of the attack clock pulse ACP is stopped. As a consequence, the count value of the counter 12 is held at a constant value, and a constant sustaining is effected.

When a decay start signal DS is applied from the assigment circuit 4, a decay clock pulse DCP is selected by the clock selection circuit 11, whereby driving of the envelope counter 12 is started, and the envelope of a decay part is read out from the envelope memory 13. Upon completion of this reading out of the decay part, a decay finish signal DF is produced as output from the counter 12, and the transmission of the decay clock pulse DCP is stopped. At the same time, the signal DF is supplied to the assignment circuit 4, and the clear signal CC is produced as output from the assignment circuit 4. This clear signal CC is applied by way of an OR circuit 14 to the envelope counter 12 to clear the count value of the relevant channel to zero.

The envelope waveform having parts such as attack, sustain, and decay read out from the envelope memory 13 is applied to the musical tone waveform memory 8 and controls the amplitude of the musical tone waveform read out from this memory 8. This applies to the case where a memory of the character described in the specification of U.S. Pat. No. 3,890,602. is used for the musical tone waveform memory 8. That is the power voltage of the musical tone waveform sample point amplitude value produced as output in the form of an analog voltage is caused to fluctuate in accordance with the envelope waveform. Accordingly, in the case where a separate read only memory or the like is used for the memory 8, a weighting circuit (not shown) is separately provided, and in this weighting circuit, the amplitude of the musical tone waveform is controlled in accordance with the envelope waveform.

The musical tone signal which has been envelope controlled is applied to a control circuit 15 for controlling tone colour, tone volume, and the like, where the tone colour, tone volume and like characteristics of the signal are controlled. The resulting signal is then passed through an audio system 16 to be produced as sound.

Octave slide control

Figure 5:
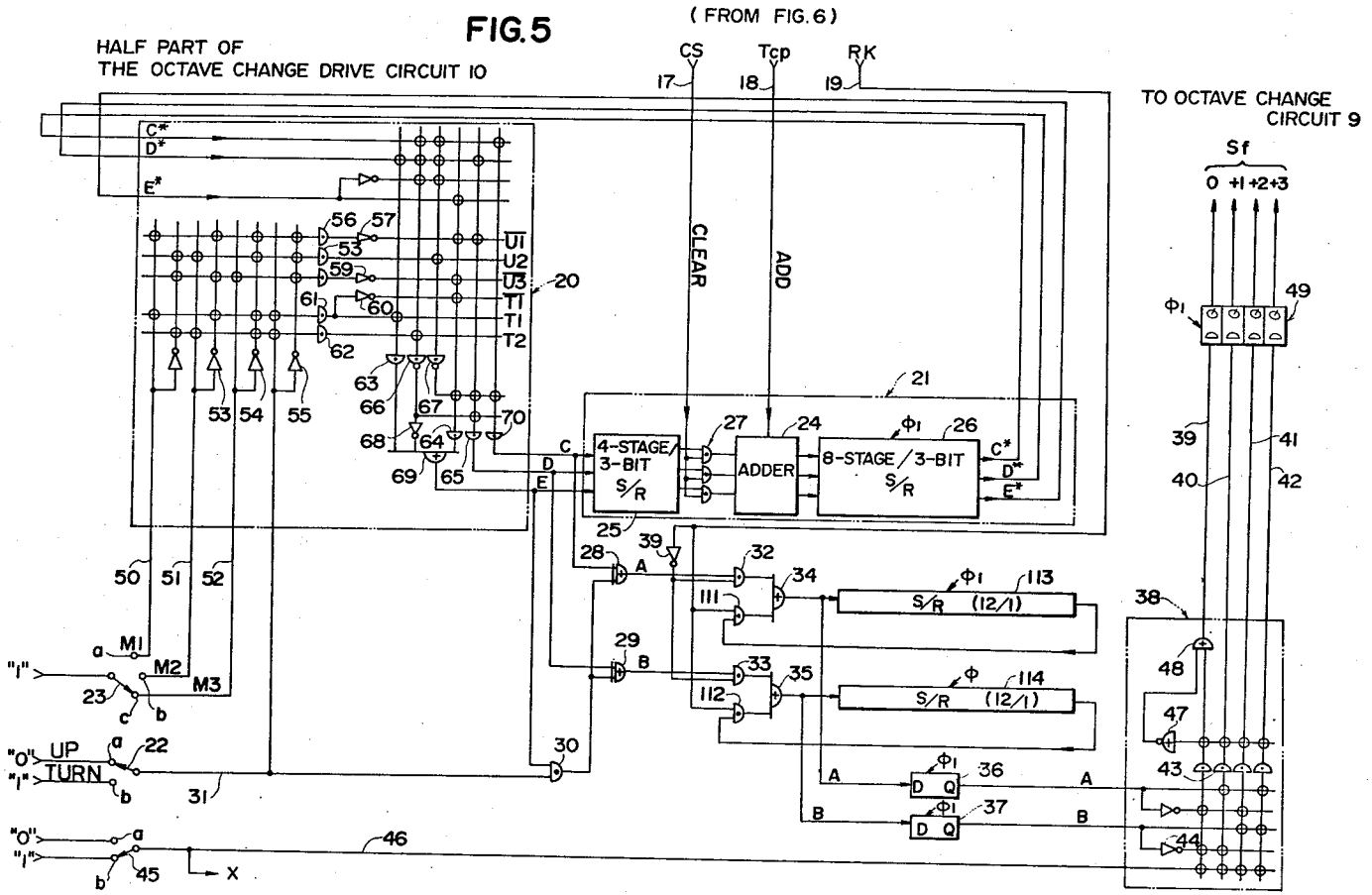
FIG. 5 is a detailed block diagram showing one half part of an octave change drive circuit.
Figure 6:
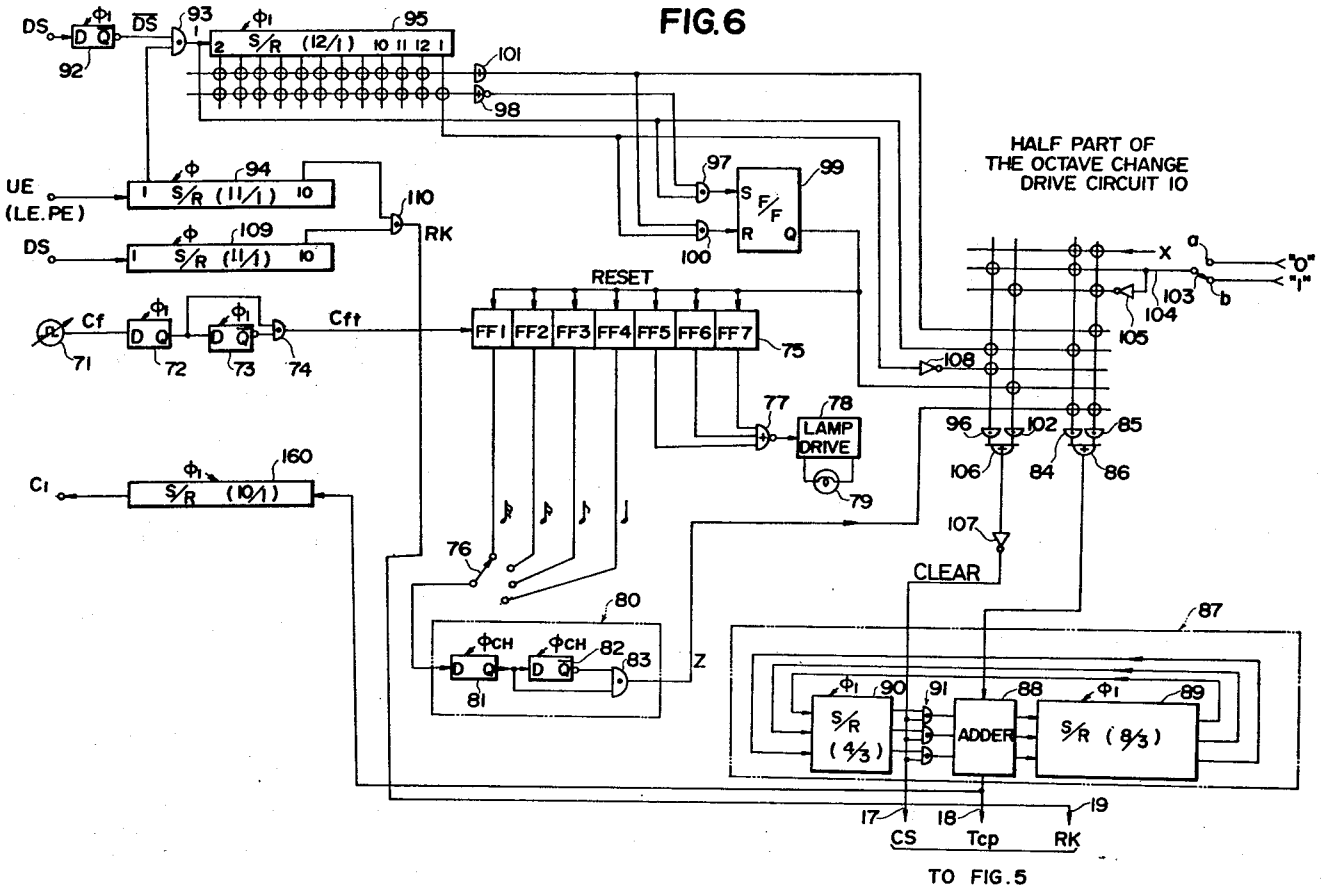
FIG. 6 is a detailed block diagram showing the other half part of the octave change drive circuit.

Details of a specific example of the octave change drive circuit 10 are shown in the circuit diagrams of FIGS. 5 and 6. FIG. 5 shows the circuit of a section for forming a shift quantity designating signal S*f*, which varies periodically in accordance with a set pattern of "up mode" or "turn mode". The circuit shown in FIG. 6 is that of a section for supplying a clock pulse T*cp* for determining the period of the above mentioned variation to the circuit shown in FIG. 5 in accordance with the setting of the "jump mode" or the "random mode". The circuits shown in FIGS. 5 and 6 are connected by lines 17, 18, and 19 and constitute the integral octave change drive circuit 10.

Figure 7:
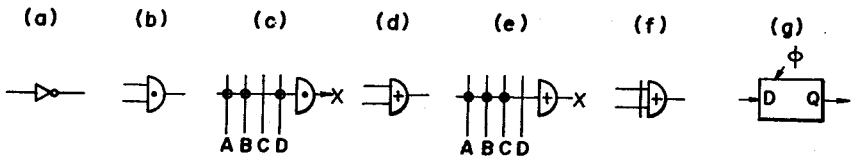
FIG. 7 is a diagram indicating the manner in which logical circuit elements are represented in the drawings.

Before the details of the circuits illustrated in FIGS. 5 and 6 are described, the method of symbolically representing logical circuits in the accompanying drawings will be explained with reference to FIG. 7. FIG. 7(*a*) represents an inverter, FIGS. 7(*b*) and 7(*c*) represent AND circuits, FIGS. 7(*d*) and 7(*e*) represents OR circuits, FIG. 7(*f*) represents an exclusive OR circuit, and FIG. 7(*g*) represents a delay flip-flop. In the case where the number of inputs is small in an AND circuit or an OR circuit, the method indicated in FIGS. 7(*b*) and 7(*d*) is adapted, while in the case where the number of inputs is large, the method indicated in FIGS. 7(*c*) and 7(*e*) is adopted.

In the method indicated in FIGS. 7(*c*) and 7(*e*), an input line is drawn on the input side of the circuit, this input line and signal lines being caused to intersect, and the intersections of the input line and signal lines of signals to be introduced as input into the circuit are enclosed within circular marks. Thus, in the case indicated in FIG. 7(*c*), the logical equation is $X=A\cdot B\cdot D$, while in the case indicated in FIG. 7(*e*), the logical equation is $X=A+B+C$.

In the octave change drive circuit 10 illustrated in FIG. 5, a conversion circuit 20 receives counting outputs E*, D*, and C* of a counter circuit 21 and converts these outputs into slide quantity and slide pattern code E, D, C in accordance with the set positions of a slide mode selection switch 22 and a slide quantity selection switch 23. The counter circuit 21 receives the above mentioned slide quantity and slide pattern code E, D, C and adds to the value of the code E, D and C the slide step setting clock pulse Tcp. More specifically, the code E, D, C indicate slide quantity (i.e., quantity of slide or staggering of tone pitch in octave units) at the present time in a certain slide pattern. Therefore, the binary value E*, D*, C* which have had 1 added thereto by the pulse T*cp* act upon the conversion circuit 20 in a manner to designate the slide quantity of the succeeding step in the same slide pattern.

In this manner, the conversion circuit 20 and the counter circuit 21 operate cooperatively and form the slide quantity and slide pattern code E, D, C which realize the slide pattern designated by the switches 22 and 23. The content of the code E, D, C varies with the introduction of the clock pulse Tcp. Accordingly, the rate of variation of the slide quantity is determined by the slide step setting clock pulse Tcp.

The counter circuit 21 comprises an adder 24 of 3 bits, a shift register 25 of 4 stages (1 stage = 3 bits), and a shift register 26 of 8 stages (1 stage = 3 bits) and is adapted to be used commonly for 12 channels in a time shared manner. When a clear signal CS from the circuit section shown in FIG. 6 is applied through a line 17 to an AND circuit group 27, the count values E*, D* and C* of the relevant channels are cleared.

An AND circuit 30 and exclusive OR circuits 29 and 28 receive separately the bits of the code E, D, C as input and form slide quantity designating code B, A in accordance with the set position of the slide mode selection switch 22. When the switch 22 is set in its *a* position, a signal "0" is led through a line 31 and designates "up mode". When the switch 22 is set in its *b* position, a signal "1" is led through the line 31 and designates "turn mode".

The slide quantity selection switch 23 operates to set the maximum slide quantity. When this switch 23 is set in its *a* position, the maximum pitch slide of the musical tone is one octave (ML). When the switch 23 is set in its *b* position, the maximum pitch slide is 2 octaves (*m*2), and when it is set in its *c* position, the maximum pitch slide is 3 octaves (M3). A signal "1" is conducted in accordance with the set position of this switch 23.

In Table 3, column I indicates the mode of variation of the output code E, D, and C of the conversion circuit 20 in correspondence to the set positions of the switches 22 and 23.

Table 3

| slide mode (switch 22) | max. slide quantity (switch 23) | E | (I) D | C | B | (II) A | (III) Sf | Variation sequence |
|---|---|---|---|---|---|---|---|---|
| | M 1 | 0 | 0 | 0 | 0 | 0 | 0 | ↓ |
| | | 0 | 0 | 1 | 0 | 1 | +1 | ↓ |
| | | 0 | 0 | 0 | 0 | 0 | 0 | ↓ |
| | M 2 | 0 | 0 | 1 | 0 | 1 | +1 | ↓ |
| up mode | | 0 | 1 | 0 | 1 | 0 | +2 | ↓ |
| | | 0 | 0 | 0 | 0 | 0 | 0 | ↓ |
| | M 3 | 0 | 0 | 1 | 0 | 1 | +1 | ↓ |
| | | 0 | 1 | 0 | 1 | 0 | +2 | ↓ |
| | | 0 | 1 | 1 | 1 | 1 | +3 | ↓ |

Table 3-continued

| slide mode (switch 22) | max. slide quantity (switch 23) | (I) E | D | C | (II) B | A | (III) Sf | Variation sequence |
|---|---|---|---|---|---|---|---|---|
| | | 0 | 0 | 0 | 0 | 0 | 0 | ↓ |
| | M 1 | 0 | 0 | 1 | 0 | 1 | +1 | ↓ |
| | | 1 | 1 | 0 | 0 | 1 | +1 | ↓ |
| | | 1 | 1 | 1 | 0 | 0 | 0 | ↓ |
| | | 0 | 0 | 0 | 0 | 0 | 0 | ↓ |
| | M 2 | 0 | 0 | 1 | 0 | 1 | +1 | ↓ |
| turn mode | | 0 | 1 | 0 | 1 | 0 | +2 | ↓ |
| | | 1 | 0 | 1 | 1 | 0 | +2 | ↓ |
| | | 1 | 1 | 0 | 0 | 1 | +1 | ↓ |
| | | 1 | 1 | 1 | 0 | 0 | 0 | ↓ |
| | | 0 | 0 | 0 | 0 | 0 | 0 | ↓ |
| | | 0 | 0 | 1 | 0 | 1 | +1 | ↓ |
| | M 3 | 0 | 1 | 0 | 1 | 0 | +2 | ↓ |
| | | 0 | 1 | 1 | 1 | 1 | +3 | ↓ |
| | | 1 | 0 | 0 | 1 | 1 | +3 | ↓ |
| | | 1 | 0 | 1 | 1 | 0 | +2 | ↓ |
| | | 1 | 1 | 0 | 0 | 1 | +1 | ↓ |
| | | 1 | 1 | 1 | 0 | 0 | 0 | ↓ |

The sequence of variation of the contents of the code E, D, C varies by successive repetition in accordance with the sequence indicated by the arrows in Table 3. For example when the maximum slide quantity with the up mode is one octave (M1), the contents of the code E, D, C vary by repetition of 000 → 001 → 000 → 001 → 000 → . . . . The timing of this variation is according to each instance of change of the contents of the count values C*, D*, and E* introduced into the conversion circuit 20 when the clock pulse Tcp is sent to the counter circuit 21. Logical circuits are so combined in the conversion circuit 20 that the contents of the output code E, D, C will vary as indicated in column I of Table 3 in correspondence to the set positions of the slide mode in the switch 22 and to the set positions of the maximum slide quantity in the switch 23.

A bit E of the slide quantity and slide pattern code C, D, E is introduced as input into the aforementioned AND circuit 30. As is apparent from column I of Table 3, the bit E becomes the signal "1" only in the "turn mode". A line 31 from the switch 22 is connected to the other input terminal of the AND circuit 30 and introduces a signal "1" as input in the turn mode designation by setting of the switch 22 in its *b* position.

When the conditions of the AND circuit 30 are fulfilled in this manner, a signal "1" is applied as one of the inputs of each of the exclusive OR circuits 28 and 29. A bit C is introduced as input into the exclusive OR circuit 28, while a bit D is introduced as input into the exclusive OR circuit 29. The output of the circuit 28 becomes a bit A, while the output of the circuit 29 becomes a bit B thereby to form slide quantity designation code B, A. Accordingly, these slide quantity designation codes B, A acquire contents as shown in column II of Table 3 in correspondence to the contents of the output code E, D, C of the conversion circuit 20.

That is, when the bit E is "0", the bits D and C pass as they are through the exclusive OR circuits 29 and 28 to become slide quantity designation code B, A, and, when the bit E is "1", the bits D and C are inverted in the exclusive OR circuits 29 and 28 to become slide quantity designation codes B, A. The exclusive OR circuits 28 and 29 are provided for forming a descending pitch variation pattern in the turn mode as indicated in FIGS. 1(*d*), 1(*e*), and 1(*f*).

The outputs A and B of the exclusive OR circuits are passed through AND circuits 32 and 33, OR circuits 34 and 35, and delay flip-flops 36 and 37 to be introduced as input into a decoder 38. A signal transmitted through the line 19 is inverted in an inverter 39 and is being applied to the other input terminal of each of the AND circuits 32 and 33, and the signal RK of the line 19 is "0" when the key which is tone reproduction assigned to the relevant channel is being depressed and is "1" when the key is released. Accordingly, when the key is being depressed, the outputs A and B of the exclusive OR circuits 28 and 29 are supplied to the decoder 38.

The decoder 38 operates in response to the slide quantity designation code B, A of the contents indicated in column II of Table 3 applied thereto as input to produce as output a shift quantity designation signal S*f* as indicated in column III of Table 3. If, as a result of decoding of the slide quantity designation code B, a signal "1 " is produced in an output line 39, the shift quantity designation signal S*f*(O) designates that shift should not be made. Consequently, a pitch variation does not occur. The signal S*f*(+1) at the time when a signal "1" is produced in an output line 40 designates that a shift of one digit to the more significant digit side (i.e., to the left) and raises the pitch by one octave. The shift quantity designation signal S*f*(+2) at the time a signal "1" is produced in an output line 41 designates a shift of two digits to the more significant digit side and raises the pitch by two octaves. The shift quantity designation signal S*f* (+3) at the time when a signal "1" is produced in an output line 42 designates a shift of three digits to the more significant digit side and raises the pitch by three octaves.

An example of operation of the decoder 38 is as follows. When the slide designation code B, A are "01", a signal "1" of the bit A is applied to an AND circuit 43, and a signal "0" of the bit B is applied through an inverter 44 to the same AND circuit 43. In the case where the octave slide effect is to be attained, an octave slide selection switch 45 is set in its *b* position indicated in FIG. 5, and a signal "1" is sent through a line 48. Since the signal "1" of the line 46 is being applied to the AND circuit 43, the conditions of this circuit 43 are fulfilled, and the signal of the output becomes "1". Therefore, the signal through the output line 40 of the decoder 38 becomes a signal "1".

The shift quantity designation signal Sf varies in the above described manner in conformance with a specific pattern as shown in Table 3 in accordance with the set positions of the slide mode selection switch 22 and the slide quantity selection switch 23, and a periodic pitch variation as indicated in FIG. 1 is specified.

Referring to Table 3 and to FIG. 1, when the maximum slide quantity is one octave (M1) in the up mode, the shift quantity designation signal Sf repeats the shift quantity "0" and the 1-digit shift (+1) and repeats the cycle of the original pitch (slide quantity zero) and the pitch variation to one octave above as indicated in FIG. 1(*a*). When, in the up mode, the maximum alide quantity is two octaves (M2), a periodic pitch variation is repeated as indicated in FIG. 1(*b*), and when the slide quantity is three octaves (M3) a periodic pitch variation is repeated as indicated in FIG. 1(*c*). In the turn mode, when the maximum slide quantity is one octave (M1), the shift quantity designation signal S*f* repeats the cycle of shift quantity 0 → 1-digit shift (+1) → 1-digit shift → shift quantity O → shift quantity O → 1-digit shift (+1) →. . . and repeats a pitch variation as indicated in FIG. 1(d). In the turn mode, a periodic pitch variation is repeated as indicated in FIG. 1(*e*) when the maximum slide quantity is two octaves (M2) and as indicated in FIG. 1(*f*) when the maximum slide quantity is three octaves (M3).

In the case where the octave slide effect is not to be attained, the octave slide selection switch 45 is set in its *a* position, and a signal "0" is transmitted through the line 46. Consequently the outputs of all AND circuits of the decoder 38 become "0". This output is received as input by a NOR circuit 47, whose output becomes "1". The output signal "1" of the NOR circuit 47 is led out through an OR circuit 48 into the output line 39 of the decoder 38, and the shift quantity designation signal S*f* continually designates a shift quantity "0". Consequently, irrespective of the content of the slide quantity designation code B, A at this time, the tone pitch does not vary.

The delay flip-flops 36 and 37 and a delay flip-flop group 49 provided on the input and output sides of the decoder 38 are thus provided to meet requirements of circuit design with consideration of operational delay time in the drive circuit 10 and function to synchronize the channel time of the shift quantity designation signal Sf sent out to the octave change circuit 9 with the correct channel time (i.e., the channel time of the output *q*F of the accumulator 7).

In the conversion circuit 20, there are six modes in which certain input code E*, D* and C* is converted into certain corresponding output code E, D, C. More specifically, conversion logics of conversion of the input code E*, D*, C* into the output code E, D, C are combined in correspondence respectively to the combinations of a total of six modes resulting from the two slide modes, namely, the up mode and the turn mode, and the maximum slide quantity of three octaves (first, second, third octaves) in each mode. The detailed contents of these conversion logics are as indicated within the block of conversion circuit 20 shown in FIG. 5. The details of the conversion logics are described below with respect to a number of examples.

1. When, in the up mode, the maximum slide quantity is one octave —

The switch 22 is set in its *a* position, and the signal of the line 31 is "0". The switch 23 is set in its *a* position, and the signal of a line 50 is "1", while the signals of lines 51 and 52 are "0". Consequently, the outputs of inverters 53, 54, and 55 are signals "1". As a consequence, the conditions of an AND circuit 56 are fulfilled, and a signal $\overline{U1}$, which is the output of an inverter 57 becomes "0". The signal $\overline{U1}$ is a signal which becomes "1" when, in the up mode, the slide quantity is other than M1. A signal U2 which is the output of an AND circuit 58 is "0"; a signal U3 which is the output of an inverter 59 is "1"; a signal $\overline{T1}$ which is the output of an inverter 60 is "1"; a signal T1 which is the output of an AND circuit 61 is "0"; and a signal T2 which is the output of an AND circuit 62 is "0". Consequently, signals "0" are introduced as input into AND circuits 63, 64, and 65, which are thereby inoperative.

Furthermore, since signals "0" are applied as input to NAND circuits 66 and 67, the outputs of these circuits 66 and 67 are signals "1". As a consequence, the output of an inverter 68 is "0", and, since all three inputs of an OR circuit 69 are "0", its output becomes "0". Since a signal "1" is supplied from the NAND circuit 67 as input to an AND circuit 70, this AND circuit 70 is enabled.

As a result of the switches 22 and 23 being set in their respective *a* positions, the operations of the logical circuit 53 through 69 are established as described above. Accordingly, the bit E which is the output of the OR circuit 69 is "0", and the bit D which is the output of the AND circuit 65 is also "0", being continually constant without being influenced by the content of the input code E*, D*, C*. Only the bit C which is the output of the AND circuit 70 varies in accordance with the contents of the input code E*, D*, C*. This point will be described with reference to Table 4.

Table 4

When, in the up mode, the maximum slide quantity is M1

| Step (timing of generation of Tcp) | input codes (count value) E* | D* | C* | output codes E | D | C | B | slide quantity designation code A |
|---|---|---|---|---|---|---|---|---|
| 0 | 0 | 0 | 0 | 0 | 0 | 0 | 0 | 0 |
| 1 | 0 | 0 | 1 | 0 | 0 | 1 | 0 | 1 |
| 2 | 0 | 1 | 0 | 0 | 0 | 0 | 0 | 0 |
| 3 | 0 | 0 | 1 | 0 | 0 | 1 | 0 | 1 |
| 4 | 0 | 1 | 0 | 0 | 0 | 0 | 0 | 0 |
| 5 | 0 | 0 | 1 | 0 | 0 | 1 | 0 | 1 |
| 6 | 0 | 1 | 0 | 0 | 0 | 0 | 0 | 0 |
| 7 | 0 | 0 | 1 | 0 | 0 | 1 | 0 | 1 |
| 8 | 0 | 1 | 0 | 0 | 0 | 0 | 0 | 0 |
| 9 | 0 | 0 | 1 | 0 | 0 | 1 | 0 | 1 |
| . | | . | | | . | | . | |
| . | | . | | | . | | . | |
| . | | . | | | . | | . | |

time ↓

Since bit C* is "0" when the counting outputs E*, D*, and C* are "0", the output of the AND circuit 70 becomes "0" and the bit C of the output code becomes "0". When the clock pulse T*cp* is introduced, and the state of step 1 is assumed, the bit C* becomes "1", whereby the bit C of the output codes also becomes "1". Thereafter, even when the clock pulse T*cp* is introduced, the bits D* and C* merely become alternately "1". Therefore, the value of the bit C of the output codes repeats "0" and "1" alternately, and the slide quantity designation code B, A alternately designates tone interval slide 0 and tone interval slide of one octave.

2. When in the turn mode, the maximum slide quantity is two octaves —

The switch 22 is set in its *b* position, and the signal of the line 31 is caused to be "1". Furthermore, the switch 23 is set in its *b* position, and, with the signal of the line 51 in the state "1", the signals of the lines 50 and 52 are caused to be "0". Consequently, the signals $\overline{U1}$, $\overline{U3}$, $\overline{T1}$, and T2 become "1", and the signals U2 and T1 become "0". The relationship between the input code E*, D*, C* and the output code E, D, C in this state will be described with reference to Table 5.

Table 5

When, in the turn mode, the maximum slide quantity is M2

| step (timing of generation of Tcp) | input code (count value) E* | D* | C* | output code E | D | C | B | slide quantity code A |
|---|---|---|---|---|---|---|---|---|
| 0 | 0 | 0 | 0 | 0 | 0 | 0 | 0 | 0 |
| 1 | 0 | 0 | 1 | 0 | 0 | 1 | 0 | 1 |
| 2 | 0 | 1 | 0 | 0 | 1 | 0 | 1 | 0 |
| 3 | 0 | 1 | 1 | 1 | 0 | 1 | 1 | 0 |
| 4 | 1 | 1 | 0 | 1 | 1 | 0 | 0 | 1 |
| 5 | 1 | 1 | 1 | 1 | 1 | 1 | 0 | 0 |
| 6 | 0 | 0 | 0 | 0 | 0 | 0 | 0 | 0 |
| 7 | 0 | 0 | 1 | 0 | 0 | 1 | 0 | 1 |
| 8 | 0 | 1 | 0 | 0 | 1 | 0 | 1 | 0 |
| 9 | 0 | 1 | 1 | 1 | 0 | 1 | 1 | 0 |
| . | | . | | | . | | . | |
| . | | . | | | . | | . | |
| . | | . | | | . | | . | |

time ↓

Since a signal "0" enters as input into the AND circuits 64, 65, and 70 when the counting outputs E*, D*, C* of the counter circuit 21 is "0", the output code is "000". When the clock pulse T*cp* is introduced, and the step 1 is assumed, the bit C* becomes "1", whereby the output of the AND circuit 70 becomes "1", and only the bit C becomes "1". Then, when the clock pulse T*cp* is next introduced, and the step 2 is assumed, the input bit D* becomes "1". Since the bit C* is "0", the output of the NAND circuit 66 becomes "1", and the output of the AND circuit 65 becomes "1". Consequently, only the bit D of the output code becomes "1".

Thereafter, when the NAND circuit 66 is $C^*=0$ or $D^*=0$ or $E^*=1$, the output becomes "1". Since the output of the AND circuit 65 becomes "1" when the output of this NAND circuit 66 is "1", and, at the same time, the bit D* is "1", the bit D becomes "1" at the time of logic of D*. $(\overline{C}^* + B^*)$. This is at the time of steps 2, 4, 5, and 8. Furthermore, the bit E becomes "1" at the time of logic of $E^* + (C^*, D^*, \overline{E}^*)$. This is at the time of steps 3, 4, 5 and 9. In this connection, it is to noted that the count values E*, D*, C* in the counter circuit 21 do not increase constantly. The reason for this is that the pulse T*cp* is being added to the slide quantity and slide pattern codes E, D, C.

While the foregoing description has been set forth with respect to two examples, specific logics for realizing the patterns of Table 3 are similarly established also in the case of other patterns.

Generation of clock pulse T*cp*

In the circuit section shown in FIG. 6, a clock frequency signal C*f* outputed from an oscillator 71 of variable oscillation frequency is applied to a delay flip-flop 72, thereby being delayed by 1 clock, is applied to an AND circuit 74, and, at the same time, is further delayed by 1 clock by a delay flip-flop 73, and the inversion output thereof is supplied to the AND circuit 74. As a consequence, a pulse C*ft* of the width of a clock pulse $\phi_1$ is generated in synchronism with the pulse rise of the frequency signal C*f*. The frequency of this pulse C*ft* is the same as that of the signal C*f* and is counted by a counter 75. signal C*f* and is counted by a counter 75.

The counter 75 is a binary counter of 7 digits and frequency divides the pulse C*ft*. The frequency-divided output of the less significant 4 digits of the counter 75 is caused to be utilized for the generation of the clock pulse T*cp*. The rates of the frequency-divided outputs from respective digits are, on the bases of that of the least significant digit FF1 as reference datum, ½ thereof for the second digit FF2, ¼ thereof for the third digit FF3, and ⅛ thereof for the fourth digit FF4. By symbolizing these rates by musical notes, the 32nd note (demisemiquaver), the 16th note (semiquaver), the 8th note (quaver), and the quarter note (crotchet) can be respectively assigned. Accordingly, the constant time interval of the octave slide can be variably set in accordance with a time value of a note to be played.

The respective frequency-divided outputs of the digits FF1 through FF4 are selected by a slide rate selection switch 76.

Furthermore, the outputs of the upper digits FF5, FF6 and FF7 of the counter 75 are applied to a NOR circuit 77, and, only when the outputs of these three digits FF5, FF6, and FF7 are all "0", a signal 1 is applied to a lamp drive circuit 78 thereby to light a lamp 79. The lighting of this lamp 79 serves as a criterion or indication of the state of progress of the step of octave sliding for the operator playing the musical instrument.

Figure 8:
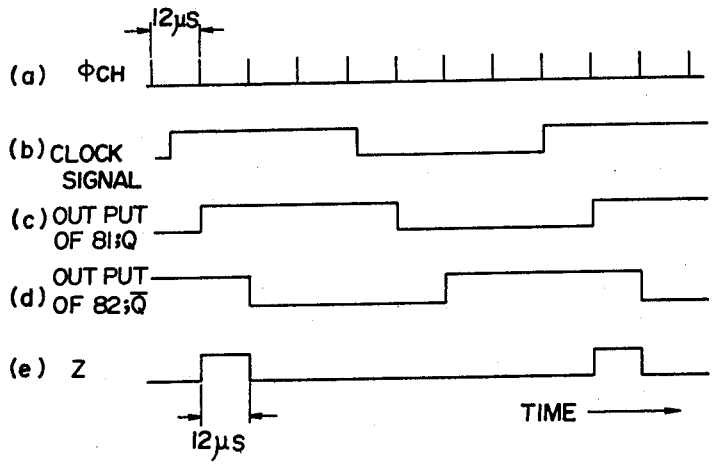
FIG. 8 is a timing chart indicating the operation of a synchronizing circuit for converting the pulse width of a clock signal.

A clock signal of a rate selected by the switch 76 is supplied to a synchronization circuit 80. This synchronization circuit 80 operates to convert the pulse width of the clock signal introduced as input thereinto into the 12 channel time (12 μs) without deleterious effect on the frequency thereof. For example, delay flip-flops 81 and 82 are operated with a clock pulse $\phi_{CH}$ (as indicated in FIG. 8(*a*)) having generation intervals of the 12 channel time (12 μs), and a clock signal (as indicated in FIG. 8(*b*)) selected by means of the switch 76 is supplied to the flip-flop 81. The flip-flop 82 delays the output (as indicated in FIG. 8(*c*)) of the flip-flop 81 by 12 μs and produces as output the inverted signal $\overline{Q}$ thereof (as indicated in FIG. 8(*d*)).

As a consequence, an AND circuit 83 produces as output a pulse of a width of 12 μs as indicated in FIG. 8(*e*). The output pulse Z of the AND circuit 83 has a pulse width which is equal to the time (12 μs) for one circulation of each channel time and a generation interval which is substantially equal to the period of the clock signal selected by means of the switch 76. In this manner, the clock signal is synchronized with the period of one circulation of each channel time. The clock signal Z thus synchronized is supplied to AND circuits 84 and 85.

The AND circuit 84 is operated at the time of "random mode", while the AND circuit 85 is operated at the time of "jump mode". The clock signal Z selected by the AND circuit 84 or 85 is applied by way of an OR circuit 86 to a counter 87 and is frequency divided into ⅛ frequency. The frequency-divided output of this counter 87 is the slide step setting clock pulse $T_{cp}$ and is supplied through the line 18 to the circuit shown in FIG. 5.

The counter 87 comprises an adder 88 of three digits, a shift register 89 of 8 stages 3 bits, a shift register 90 of 4 stages 3 bits, and an AND circuit 91. The purpose of obtaining the clock pulse T*cp* by frequency dividing the clock signal Z by means of the counter 87 is to improve the resolution of step variation at the time of random mode as described hereinafter. A further purpose is to reduce error in the time width of the initial step. Since the shift registers 89 and 90 operate integrally to accumulate the count values of 12 channels, time division, common use of the counter 87 becomes possible.

An octave slide variation is effected only while a key is being depressed. Accordingly, it is necessary to learn whether a key in each channel is being depressed or whether it is being released, and, only when a key is being depressed, the AND circuit 84 or 85 is operated to apply the clock signal Z to the counter 87. Accordingly, the decay start signal DS from the tone reproduction assignment circuit 4 (as shown in FIG. 3) is inverted by means of a delay flip-flop 92, and the resulting inverted signal $\overline{DS}$ is applied to an AND circuit 93. Furthermore, a signal indicating that a key is being depressed and a tone is being reproduced is supplied from the assignment circuit 4 to a shift register 94, and the delay output of the first bit thereof is applied to the AND circuit 93.

For a signal indicating that tones are being reproduced, the attack start signal AS for any of the keyboard signals UE through PE may be used, but the keyboard signals UE through PE are introduced as input in the case where octave sliding is carried out selectively by keyboard. For example, in the case of octave slide in only the upper keyboard, the upper keyboard signal UE is introduced as input. If the inverted decay start signal $\overline{DS}$ is "1", and the keyboard signal UE (LE, PE) is also "1", the output of the AND circuit 93 will become "1", and a signal indicating that, while, the key has been depressed, it has not been released, that is, is still being depressed, is obtained. The output of the AND circuit 93 is fed to a shift register 95 of 12 stages and, at the same time, to AND circuits 84, 96 and 97.

The jump mode will now be considered. In the jump mode, as a follow up to the slide variation of the key which has been initially depressed, the pitch of another depressed key is caused to slide. Accordingly, it is necessary to first detect the initial depression of a key. Since the shift register 95 is of 12 stages, the content of each stage corresponds to a respective channel. Consequently, the channel of a signal introduced from the AND circuit 93 as input into the register 95 coincides with the channel of a signal held in the final stage of the register 95, and the signal of the final stage represents the content immediately before (12 μs in advance) in the relevant channel.

Furthermore, the contents held in the stages of the register 95 represent the contents of the past 12 channel times immediately before the output of the AND circuit 93, and if the outputs of all stages are "0", this will mean that no keys were being depressed in the past immediately before. This is detected by a NOR circuit 98. If the output of this NOR circuit 98 is "1", this indicates that no keys were being depressed in the immediately preceding past, and this signal is applied to the AND circuit 97. Therefore, if the output of the AND circuit 93 at this time becomes "1", the output of the AND circuit 97 will become "1", and the fact that a key has been depressed first is detected.

The signal indicating the initial key depression is applied from the AND circuit 97 to the setting input terminal of a flip-flop 99 thereby to set this flip-flop 99. After the elapse of 12 channel times (12 μs) from this time, the signal I will have been shifted to the final stage of the shift register 95. The output signal 1 of the final stage is supplied to an AND circuit 100. Since the output of the AND circuit 93 again becomes that of the same channel at this time, the signal 1 indicating key depression is applied through an OR circuit 101 to the AND circuit 100. The output of the AND circuit 100 thereupon becomes "1" and resets the flip-flop 99. As a consequence, the signal "1" is produced in the output Q of this flip-flop 99 only during a period of 12 μs from the channel time at which the initial key depression was detected. The output signal 1 of the flip-flop 99 resets the counter 75 to "0" and, at the same time, is applied to an AND circuit 102.

In the case of the jump mode, a variation mode selection switch 103 is set in its *a* position, and a signal "0" is transmitted through a line 104. Consequently, the signal "1" is applied through an inverter 105 to the AND circuit 102, and the output of the AND circuit 102 becomes "1" in response to the signal "1" of 12-μs width from the above mentioned flip-flop 99. This output "1" is applied by way of an OR circuit 106 to an inverter 107. The output of this inverter 107 becomes a signal "0" only during a period of 12 μs from the detection of the initial key depression, and this is supplied as a clearance signal CS to the AND circuit group 91 of the counter 87 and the AND circuit group 27 (as shown in FIG. 5) of the counter circuit 21. Since the AND circuit group 91 and 27 become inoperative during 12 μs, the contents of all channels of the counter 87 and the counter circuit 21 are cleared to 0. In this manner, preparation is made for the steps of the octave slide start from 0 (i.e., start from the original pitch).

At the time of the jump mode, a signal X(=1) from the aforementioned octave slide selection switch 45 (FIG. 5), the output "1" of the above mentioned inverter 105, and the output "1" of the OR circuit 101 are applied to the AND circuit 85 for selection of the clock signal 7, whereby the AND circuit 85 is enabled. The output of the AND circuit 93 and the outputs of the first through eleventh stage of the register 95 are being applied to the OR circuit 101, and, if a key is being depressed in any of the channel, a signal "1" is continually being outputted. Consequently, the clock signal Z selected by the switch 76 and synchronized with the 12-μs width by the synchronization circuit 80 is sent out as output as it is with a width of 12 μs from the AND circuit 85, and a pulse of 12-μs width is applied to the adder 88 of the counter 87.

In the counter 87, since the registers 89 and 90 are being shifted by the main clock pulse $\phi_1$, the count values of the three bits of the 12 stages (corresponding to the 12 channels) all become the same value. Accordingly, the frequency-divided output of the counter 87, that is, the digit raising signal of the adder 88 is produced during 12 μs corresponding to the total channel time. Since this frequency-divided output is utilized as the slide step setting clock pulse T*cp*, the clock pulse T*cp* has a pulse width of 12 μs. That is, in the jump mode, the clock signal Z is frequency divided by the counter 87 with respect to all channels, and the slide step setting clock pulse T*cp* becomes common for all channels.

As a consequence, in the counter circuit 21 (FIG. 5), into which this clock pulse T*cp* is fed, the counting input code E, D, C is counted commonly in all channels, and the values of the counting outputs E*, D*, C* are common in all channels. Accordingly, the code E, D, C sent out as output from the conversion circuit 20 (FIG. 5) and the slide quantity designation code B, A formed on the basis of these codes is the same in all channels, and the shift quantity designation signal S*f* is the same in all channels. That is, the shift quantity designation signal S*f* supplied to the octave change circuit 9 (FIG. 1) does not vary in the time period from the first channel time through the twelfth channel time and designates the same shift quantity (slide quantity) in all of the channels.

Thus, the steps of octave slide of all channels advance simultaneously from the time of the initial key depression. Accordingly, as indicated in FIG. 2(*a*), even when key depressions are successively carried out at different times, as first key, second key, third key, . . . , all tones vary uniformly with the same slide quantity. For example, when the depression of the third key is started, production of its tone is started from a pitch which is two octaves higher than the original pitch when the slide quantity is (+2). That is, tone reproduction is started from a tone two octave higher by leaping over the original pitch (i.e., by jumping).

Random mode

In the random mode, the octave slide control of the different keys is carried out in separate steps as indicated in FIG. 2(*b*). This is accomplished in practice by carrying out independent counting by channel in the counter 87 or the counter circuit 21. Accordingly, the clock pulse T*cp* must be generated separately for different channels assigned to depressed keys.

The counter 87 or the counter circuit 21 is cleared separately for different channels at the start of depression of keys of tones assigned to the different channels. The starting of key depression in a certain channel can be detected, when a signal ("1") indicating the condition of key depression is outputted from the AND circuit 93, by examining the output of this AND circuit 93 at a time 12 channel times before. The output signal of the AND circuit 93 at a time 12 channel times previous is being held in the final stage (delayed by 12 μs) of the shift register 95.

When the signal at the time 12 channel times before, that is, the signal of the final stage of the register 95 is "0", this means that no key was being depressed previously. When the output of the AND circuit 93 at that time is "1", this means that key depression has started. Accordingly, by inverting the output of the final stage of the register 95 by means of an inverter 108, applying the inverted output to the AND circuit 96, and, at the same time, applying the output of the AND circuit 93 to the same AND circuit 98, the start of key depression in each channel in the same AND circuit 96 can be detected. At the time of random mode, the switch 103 is set in its *b* position, and the signal "1" transmitted through the line 104 is continually supplied to the AND circuit 96.

When the key depression is sustained, and the output of the AND circuit 93 is "1", the output at the time 12 channel times previous is also "1", and therefore the output of the inverter 108 becomes "0", whereby the conditions of the AND circuit 96 are not fulfilled. Consequently, the output of the AND circuit 96 becomes "1" only during one channel time of the relevant channel at the time of start of key depression therein. The output of the AND circuit 98 passes through the OR circuit 108 and the inverter 107 and, as a clearance signal CS, in supplied to the counter 87 and further through the line 17 to the counter circuit 21 (FIG. 5). As a consequence, the clearance signal CS, which is "0" in the random mode, is produced with a width of 1 μs only in the channel in which a key has been depressed. Therefore, the count value of the counter 87 or the counter circuit 21 is cleared to 0 in only in that channel, and the contents of the other channels are not cleared.

To the AND circuit 84 for selecting the clock signal Z at the time of random mode, a signal X (which is "1" when octave slide function is performed) from the aforementioned octave slide selection switch 45 (FIG. 5), signal "1" from the line 104 of selected random mode, and the output of the AND circuit 93 are applied. From the AND circuit 93, as mentioned hereinbefore, a signal "1" is produced only during the time of the channel in which a key is being depressed. Accordingly, at the time when a pulse of 12-μs width of the clock signal Z has been produced, and, moreover, in the channel time (1 μs) during which the key is depressed, a pulse of 1-μs width is produced as output from the AND circuit 84.

This output pulse of the AND circuit 84 is of a frequency which is the same as the frequency of the clock signal Z, and the pulse generation timing is synchronized with the time of the channel with key depression. As a consequence, in the counter 87, counting progresses in only a channel into which a pulse has been sent by way of the AND circuit 84 and the OR circuit 86. Therefore, the count contents of the different channels in the counter 87 are not in agreement and assume random values in accordance with the timings of key depression starting of the keys assigned to the channels.

As is apparent from the foregoing description, the frequency of the clock signal Z is frequency divided separately for the different channels in the counter 87. Accordingly, the timing with which the frequency-divided output (i.e., the digit raising signal of the adder 88) is produced differs with the different channels, and the slide step setting clock pulse T*cp* applied through the line 18 to the counter circuit 21 shown in FIG. 5 is produced in the different channels with separate timings.

In the case of the jump mode, the clock pulse T*cp* is common to all channels, but in the case of the random mode, a clock pulse T*cp* is generated separately for each channel in the counter 87. If the counter 87 were not provided, a clock signal Z selected by the AND circuit 84 during the time of a channel in which a key is being depressed would be utilized as it is as the clock pulse T*cp* by the counter circuit 21. This, however, would give rise to coincidence in all channels of the timings of step variation even if the slide quantities in the different channels differ, and it would not be possible to obtain random slide sensation in each channel.

When the clock signal Z is frequency divided separately for each channel by the counter 87, the clock pulse T*cp* is not produced as long as clock signals Z of a specific number (eight) are not introduced in the relevant channel, whereby clock pulses T*cp* are produced with separating timing. Therefore, the timing of step variation of octave slide differs with channel.

The resolution of step variation timing is determined by the number of frequency-division stages of the counter 87. For example, in the case of frequency division to ⅛ with three frequency-division stages, the resolution of variation timing in one step becomes ⅛. The resolution becomes finer with increase in the number of frequency-division stages. As the resolution becomes finer, the probability of coincidence of the step variation timings in all channels becomes lower, and a more random sensation can be imparted.

In the counter circuit 21, "1" is added to the input code E, D, C only in the channels into which the clock pulse $T_{cp}$ is introduced. Then, the steps of octave sliding are separately advanced only in the channels which have been assigned depressed keys. A shift quantity designation signal S*f* in accordance with these steps is applied to the octave change circuit 9 during the relevant channel times. Accordingly, in the case where keys are successively depressed at different times in the order of a first key, second key, third key, . . . as indicated in FIG. 2(*b*), the different tones are slide controlled separately.

Envelope control in octave slide

Figure 9:
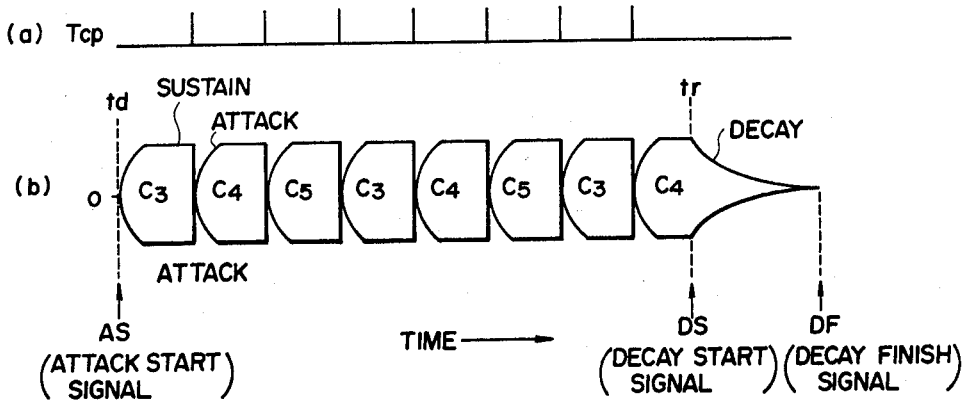
FIG. 9 is a graph indicating envelope control in an octave slide performance.

The pitch varies at every step in octave slide. In order to cause this pitch variation to stand out and thereby to produce a clear and crisp sensation, an envelope control as indicated in FIG. 9(*b*) is carried out. This FIG. 9(*b*) illustrates an example wherein octave slide control with up mode is carried out when the key of $C_3$ tone is depressed. Steps are advanced with up mode in accordance with the generation of the slide step setting clock pulse T*cp* indicated in FIG. 9(*a*), and the pitch is caused to slide as $C_3$ tone → $C_4$ tone → $C_5$ tone → $C_3$ tone . . . up to a maximum of the octaves.

The clock pulse T*cp* produced as output from the counter 87 (FIG. 6) is fed into a shift register 160 and, being appropriately time delayed therein, is synchronized with the original channel time. In the example illustrated in FIG. 6, this clock pulse T*cp* is delayed by 10 bit times (10 μs) and outputted as an envelope clear signal $C_1$ from the drive circuit 10. The shift register 160 is provided for the purpose of synchronization with a channel time. In the example shown in FIG. 6, the circuit is so adapted that a delay of 2 μs is produced between the channel time (original channel time) of the decay start signal DS fed into the drive circuit 10 or the keyboard signal UE through PE and the channel time of the clock pulse T*cp* produced as output from the counter 87. For this reason, the clock pulse T*cp* is delayed further by 10 μs in the shift register 160 and caused to coincide with the original channel time. Therefore, the envelope clear signal $C_1$ and the clock pulse T*cp* are signals of substantially the same content.

The envelope clear signal $C_1$ is applied to the OR circuit 14 (FIG. 3) of the envelope generation circuit 5 and clears the count value of the relevant channel of the envelope counter 12 to 0.

When the key of $C_3$ is depressed at the time instant *tr* (FIG. 9), frequency information F (Table 3) of the $C_3$ tone are read out from the frequency information storing device 6 and are successively counted by the accumulator 7. At this time, the relevant channels of the counter 87 (FIG. 6) and the counter circuit 21 (FIG. 5) are cleared to 0, and counting of the clock signal Z in the relevant channel is started from 0 in the counter 87.

Until 8 pulses of the clock signal Z are sent, the count value E*, D*, C* of the counter circuit 21 sustain 0, and the shift quantity designation signal S*f* designates shift quantity 0. Consequently, the output *q*F of the accumulator 7 is applied as it is to the memory 8 without being shifted by the octave change circuit 9. Thus, a musical tone signal of the pitch of $C_3$ is generated.

Since an attack start signal AS is applied to the envelope generation circuit 5, counting is started from 0 at the envelope counter 12, and an attack envelope is read out from the envelope memory 13. Accordingly, the amplitude of the musical tone rises as indicated in FIG. 9(*b*), and thereafter the sustain level is held.

When 8 pulses of the clock signal Z are introduced into the counter 87 (FIG. 6), the clock pulse T*cp* is generated. This clock pulse T*cp* is fed into the counter circuit 21 and advances the slide quantity by one step. At the same time, this clock pulse T*cp* is applied as the envelope clear signal $C_1$ to the envelope counter 12, the relevant channel of which is cleared to 0. As a consequence, the amplitude read out from the envelope memory 13 becomes 0, and the musical tone amplitude drops rapidly to 0 as indicated in FIG. 9(*b*). As a result, a sensation as though the tone is intermittent is imparted.

The counter 12, which has been forcibly cleared to 0 by the envelope clear signal $C_1$, again starts the counting of the attack pulse ACP from 0. Consequently, an attack envelope is again read out from the memory 13. At this time, the steps of the octave slide are advanced, and the shift quantity designation signal S*f* is designating a shift-up of one digit. For this reason, the output *q*F of the accumulator 7 is shifted up by one digit by the octave change circuit 9, and an address code which is two times the address designated by counter 7 is introduced as input into the memory 8. Consequently, a musical tone waveform is read out at a rate which is twice that of the $C_3$ tone from the memory 8. Therefore, attack is started when the pitch changes to the $C_4$ tone.

Then, each time the clock pulse T*cp* is similarly generated thereafter and the step changes, the envelope amplitude is cleared to 0, and attack is started together with variation of the pitch.

When a key is released, the decay start signal DS becomes "1", and, since tone reproduction is still being carried out, the keyboard signal UE (LE, PE) is also "1". These signals DS and UE are delayed appropriately in the shift registers 109 and 94 (FIG. 6) and thereafter fed into an AND circuit 110. The output signal RK of this AND circuit 110 is "1" when the key is released in the relevant channel and attenuated tone reproduction is being carried out. This signal RK passes through the line 19 and is applied to AND circuits 111 and 112 of the circuit section shown in FIG. 5. The outputs of the final stage of the shift registers 113 and 114 are applied to the other input terminals of the AND circuits 111 and 112.

The shift registers 113 and 114 have 12 shift stages in correspondence to the number of channels and temporarily store the aforementioned slide quantity designation code B, A received as output through the exclusive OR circuits 29 and 28, AND circuits 33 and 32, and OR circuits 35 and 34. Consequently, the slide quantity designation code B, A in the relevant channels before the 12 channel times (immediately before) are recorded in the registers 114 and 113.

When the key is released, the signal RK becomes "1". Consequently, the AND circuits 32 and 33 are disenabled and the AND circuits 111 and 112 are enabled. As a consequence, the shift quantity designation code B, A immediately before the key release pass through the AND circuits 111 and 112 and OR circuits 34 and 35 and are held by the shift registers 114 and 113. Therefore, subsequent to the key release, the contents of the slide quantity designation code B, A applied to the decoder 38 does not vary irrespective of the manner in which the slide quantity and slide pattern code E, D, C change.

For example, if, in the case of FIG. 9(*b*), the key is released at the time instant *tr*, the slide quantity at that time is one octave, and $C_4$ tone which is one octave above the original pitch $C_3$ is being reproduced. This $C_4$ tone is sustained as it is until completion of tone reproduction. More specifically, when the decay start signal DS is applied at the time instant *tr* to the envelope generating circuit 5, the envelope counter 12, which has been holding a constant count value of sustain, starts to count the decay clock pulse DCP. As a consequence, a decay envelope is read out from the envelope memory 13. Therefore, as indicated in FIG. 9(*b*), the musical tone is held as $C_4$ tone, and its amplitude is gradually attenuated until, ultimately, the tone production is fully completed.

As this time, a decay finish signal DF is generated from the counter 12 and erases the various signals KC, AS, DS, UE through PE of the relevant channel. Consequently, the signal RK transmitted through the line 19 (FIGS. 5 and 6) becomes "0", and the stored information of the shift registers 113 and 114 is cleared.

The reason for delaying the signals UE (LE, PE) and DS by 10 μs in the shift registers 94 and 109 and thereafter supplying the delay signals to the AND circuit 110 to cause the signal RK to be generated is to cause coincidence with the delay of the channel time in the drive circuit 10. More specifically, the timing of generation of the clock pulse $Tcp$ in the circuit shown in FIG. 8 is delayed by 2 μs relative to the original channel time as mentioned hereinbefore, and the channel time is further delayed by 8 μs by the shift register 26 (FIG. 5) of 8 stages. Consequently, the timing of the outputs of the exclusive OR circuits 28 and 29 or the inputs of the AND circuits 32, 33, 111, and 112 is retarded by 10 μs. Therefore, by causing the signal RK used in these AND circuits 32, 33, 111, and 112 to be also retarded by 10 μs, the channel times coincide.

Figure 10:
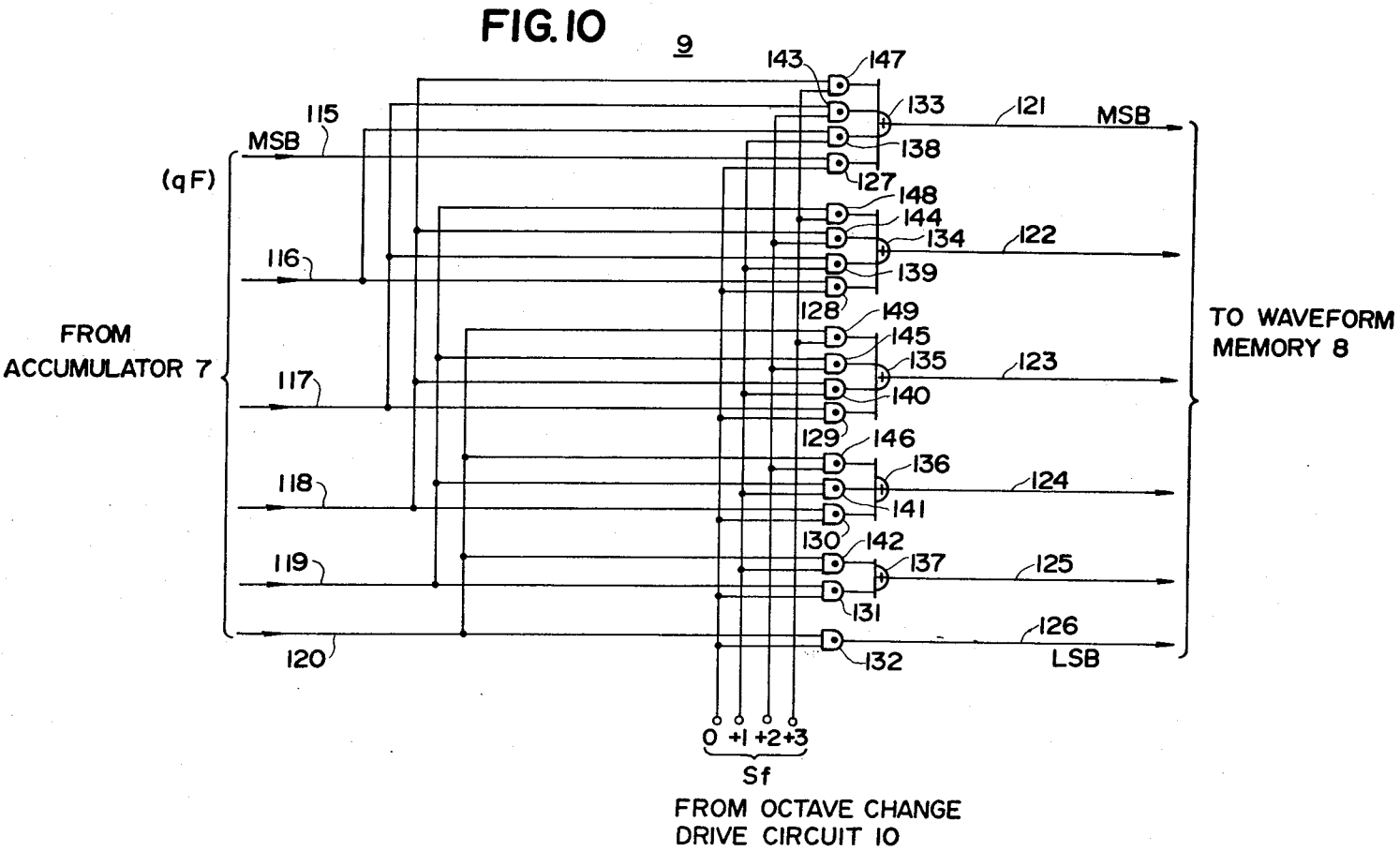
FIG. 10 is a circuit diagram showing the construction of an octave change circuit.

For the octave change circuit 9, a circuit as shown in FIG. 10 can be used. Lines 115 through 120 are signal lines for the more significant 6 bits (integer part) of the address designation signal $qF$ outputted from the accumulator 7, the line 115 being for the most significant bit SB and the line 120 being that for an integer and a digit of 1 (weight of the 15th digit in Table 2). Lines 121 through 126 are signal lines actually connected to the address input lines of the musical tone waveform memory 8, the line 121 being that for the most significant bit MSB of the address data and the line 126 being that for the least significant bit LSB of the address data.

The logical circuit is so organized that the signals of the input lines 115 through 120 are respectively led to specific output lines 121 through 126 in correspondence to four shift contents of 0 to 3 digits. When the shift quantity designated by the octave change drive circuit 10 is 0, AND circuits 127, 128, 129, 130, 131 and 132 are enabled by the shift quantity designation $Sf(0)$. Consequently, the signals of the input lines 115 through 119 of the more significant 5 digits pass through the AND circuits 127 through 131 and OR circuits 133 through 137 and led to the output lines 121 through 125 of the more significant 5 digits. The signal of the input line 120 of the least significant digit passes through the AND circuit 132 and is led to the output line of the lowest digit.

AND circuits 138, 139, 140, 141, and 142 are enabled by the shift quantity designation signal $Sf(+1)$ designating a shift quantity of 1 digit and lead the signals of the input lines 116 through 120 respectively to the output lines 121 through 125 of 1 digit more significant. At this time, the signal of the input line 115 of the most significant digit is suppressed, and the signal of the input line 116 of one digit less significant is led to the output line 121 of the most significant digit.

AND circuits 143, 144, 145, and 146 are enabled by the signals $Sf(+2)$ designating a shift quantity of 2 digits, and the signals of the input lines 117 through 120 at respectively led to the output lines 121 through 124 of two digits more significant. At this time, the signals of the input lines 115 and 116 of the more significant two digits are suppressed, and the signal of the input line 117 of two digits less significant is led to the output line 121 of the most significant digit.

AND circuits 147, 148, and 149 are enabled by the signal $Sf(+3)$ designating a shift quantity of three digits and lead the signal of the input line 118, 119, and 120 to the output lines 121, 122 and 123. The signals of the input lines 115, 116 and 117 of the more significant three digits are suppressed, and the signal of the input line 118 of three digits less significant is led to the output line 121 of the most significant digit.

In this manner, the signals of the input lines 115 through 120 are shifted to more significant digits by one digit, two digits, or three digits in response to the shift quantity designation signals $Sf(+1, +2,$ and $+3)$ and are thus led to the output lines 121 through 126. As a result, the actual read-out addresses of the memory 8 assume a value two times (at the time of one-digit shift), four times (at the time of two-digit shift), or eight times (at the time of three-digit shift) that of the address designated by the output of the accumulator 7.

As a consequence, the rates of advance of the read-out addresses become two times, four times, or eight times, and the frequencies of waveforms read out from the memory 8 become two times, four times, or eight times. Therefore, the pitch of the musical tone thus obtained becomes one octave, two octaves, or three octaves higher than the conventional pitch.

What is claimed is:

1. An electronic musical instrument having an octave slide effect, comprising:

a memory storing sampled amplitudes of a musical tone waveform at respective addresses thereof, wherein addresses for reading out the waveform are designated by binary signals;

address generating means successively generating binary signals, each consisting of a plurality of bits, by processing frequency information corresponding to a key code for reading out said waveform sampled amplitudes from successive addresses of said memory; and octave control means for changing the octave of the reproduced musical tone by shifting the digits of the binary signals from said address generating means at constant intervals of time, said octave control means comprising;

an octave change circuit for shifting the bits of said binary signals from said address generating means by a number of places established by a shift designating signals having plural different value options each corresponding to a shift of a different number of places;

selection switch means for selecting a desired one of a plurality of different octave slide patterns, and octave change drive circuitry, responsive to said selection switch means, for providing repetitive sequences of shift designating signals, each such sequence including plural different value options in a sequential arrangement corresponding to the selected octave slide pattern.

2. An electronic musical instrument as defined in claim 1 wherein said selection switch means comprises a circuit for selecting an "up mode" and for designating a maximum extent of shift in the digits of said binary signals and in which said octave change drive circuitry provides repetitive sequences of shift designating signals that periodically shift the digits of said binary signals by successively greater numbers of places and, upon attaining the maximum shift value, restore the digits to the original octave and subsequently repeat the same operation, whereby the pitch of the musical tone is caused to vary periodically in an up mode.

3. An electronic musical instrument as defined in claim 1 wherein said selection switch means comprises a circuit for selecting a "turn mode" and for designating a maximum extent of shift in the digits of said binary signals and in which said octave change drive circuitry provides repetitive sequences of shift designating signals that periodically and successively shift the digits of the output binary signals by one octave at a time from the original pitch toward a more significant digit side and, upon attaining an octave corresponding to the maximum shift value, successively shift the digits by one octave at a time toward a less significant digit side and subsequently repeat the same operation, whereby the pitch of the musical tone is caused to vary periodically in a turn mode.

4. An electronic musical instrument as defined in claim 1 wherein said memory and said address generating means are time shared to facilitate the production of plural different musical tones, wherein said instrument has tone selection keys, and wherein, in the case where a plurality of keys are depressed successively, said octave control means includes timing circuitry, cooperating with said octave change drive circuitry and operative when a "jump mode" is selected by said switch selection means, to change the pitches of the musical tones of the succeedingly depressed keys in time and extent of octave change conformity with the octave slide of the first depressed key.

5. An electronic musical instrument as defined in claim 1 wherein said memory and said address generating means are time shared to facilitate the production of plural different musical tones, wherein said instrument has tone selection keys, and wherein, in the case where a plurality of keys are depressed successively, said octave control means includes timing circuitry, cooperating with said octave change drive circuitry and operative when a "random mode" is selected by said switch selection means, to change the octaves of the respective keys independently from each other in time and extent of octave change.

6. An electronic musical instrument as defined in claim 1 which further comprises means for variably setting said constant interval of time in accordance with a time value of a note to be played.

* * * * *